US006769789B1

(12) United States Patent
Won et al.

(10) Patent No.: US 6,769,789 B1
(45) Date of Patent: Aug. 3, 2004

(54) LAMP-HOLDER FOR FLUORESCENT LAMP

(76) Inventors: Young-sun Won, Kolon apt #4-207, 37, Dadae-dong, Saha-ku, Pusa (KR); Sang-joon Won, Kolon apt #4-207, 37, Dadae-dong, Saha-ku, Pusa (KR)

( * ) Notice: Subject to any disclaimer, the term of this patent is extended or adjusted under 35 U.S.C. 154(b) by 0 days.

(21) Appl. No.: 10/151,752

(22) Filed: May 16, 2002

(51) Int. Cl.[7] ..... H05B 33/02

(52) U.S. Cl. ..... 362/260; 362/371; 362/217; 439/232; 439/233

(58) Field of Search ..... 362/260, 371, 362/217, 226, 224; 439/232, 233, 239

(56) References Cited

U.S. PATENT DOCUMENTS 2,268,446 A * 12/1941 Gaynor ..... 439/232
3,781,759 A * 12/1973 Shelly, Jr. ..... 439/232
3,892,457 A * 7/1975 Delch et al. ..... 439/233
5,469,348 A * 11/1995 Wong ..... 362/217

* cited by examiner

*Primary Examiner*—Stephen Husar
*Assistant Examiner*—Anabel Ton
(74) *Attorney, Agent, or Firm*—Notaro & Michalos P.C.

(57) ABSTRACT

Disclosed is a lamp-holder for fluorescent lamp of detachably holding a lamp with ease and of reliably and firmly holding the lamp under the condition of being subjected to vibration or shock is disclosed. The lamp-holder body comprises a holder having a pair of resilient arms, and holding the fluorescent lamp by pushing the lamp between the arms, and a guide bar positioned between the pair of arms and extended downward, the guide bar having an arcuate guide surface for guiding insertion of the fluorescent lamp at its lower end.

3 Claims, 3 Drawing Sheets

LAMP-HOLDER FOR FLUORESCENT LAMP

BACKGROUND OF THE INVENTION

1. Field of the Invention

The present invention relates to a lamp-holder for a fluorescent lamp, and, more particularly, to a lamp-holder for fluorescent lamp which is capable of receiving a fluorescent lamp by simple pushing operation and allowing the fluorescent lamp to be easily replaced by anybody, and which is also designed to electrically connect the fluorescent lamp with terminals from a power source, thereby preventing short circuit due to bad electrical connection, and thus lengthening its service life.

2. Background of the Related Art

Generally, a common lamp-holder for fluorescent lamp is designed to have a holding recess for receiving and holding each of metal caps displaced at the opposite ends of a fluorescent lamp. The holding recess is usually provided with a pair of fitting grooves each having a strip-shaped copper terminal adapted to be contacted with each of pins extending outwardly from the metal cap.

The operation for inserting a fluorescent lamp in a lamp-holder of this type may be performed in a such way that a user carefully inserts the opposite ends of the fluorescent lamp into both lamp-holder of a lamp assembly concurrently and then rotates the fluorescent lamp about its longitudinal axis to cause its contact pins to contact with the copper terminals.

Therefore, the operation for inserting or withdrawing the fluorescent lamp into or from the above mentioned conventional lamp-holder is considerably bothersome and difficult because the user must carry out the operation while lifting his eyes to the lamp-holder under the condition of holding up the fluorescent lamp for a long time. Hence, this may cause replacement of the fluorescent lamp by a person of short stature or an old and weak person to be difficult.

Furthermore, since the conventional lamp-holder for fluorescent lamp is configured such that its fitting grooves, in which the contact pins are fitted, are not sufficiently wide to smoothly receive the contact pins, and the copper contact terminals displaced at inner sides of the fitting grooves are outwardly biased owing to their resilience, the fluorescent lamp is held in a such way that only one point of each of its contact pins engages with each of the copper contact terminals, thereby causing the electrical contact between the contact pins and the copper contact terminals to be unstable. On this account, short circuits occur frequently, resulting in shortening of service life of the fluorescent lamp and poor electrical connection therebetween.

In addition, since the fluorescent lamp is held by partial engagement of its contact pins with the contact terminals, the fluorescent lamp is likely to be withdrawn from the lamp-holder under the condition of being subjected to vibration or shock, as in such means of transportation as a train, a bus or the like. Hence, it is impossible for the lamp-holder to be used with a cheap mass-produced fluorescent lamp.

SUMMARY OF THE INVENTION

Accordingly, the present invention is directed to a lamp-holder for fluorescent lamp that substantially obviates one or more problems due to limitations and disadvantages of the related art.

It is object of the present invention to provide a lamp-holder for fluorescent lamp which is adapted to allow easy replacement of a fluorescent lamp by a simple pushing in or pulling out action.

It is another object of the present invention to provide a lamp-holder for fluorescent lamp capable of firmly holding a fluorescent lamp such that it can be used even in such means of transport as a ship, a train or the like which is likely to generate intensive vibration.

It is a further object of the present invention to provide a lamp-holder for fluorescent lamp capable of making contacts with contact pins of a fluorescent lamp reliably and stably to prevent short circuits, thereby lengthening its service life.

In order to accomplish the above objects, the present invention provides a lamp-holder for fluorescent lamp comprising a lamp-holder body fitted to a fluorescent lamp assembly and extended downward, an resilient annular holder provided at an inner side of the lamp-holder body and having an access opening facing downward, and a guide bar provided in the annular holder and at the inner side of the lamp-holder body and extended downward, which has an arcuate guide surface at its lower end.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Figure 1:
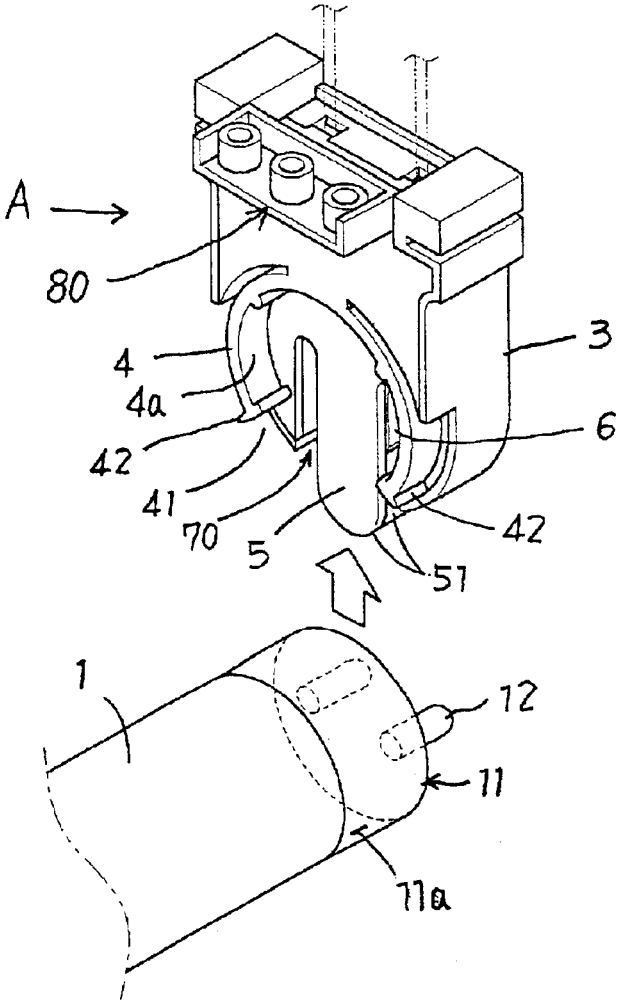
FIG. 1 is a perspective view showing a lamp-holder for fluorescent lamp according to the present invention.

Reference now should be made to the drawings, in which the same reference numerals are used throughout the different drawings to designate the same or similar components.

Figure 2:
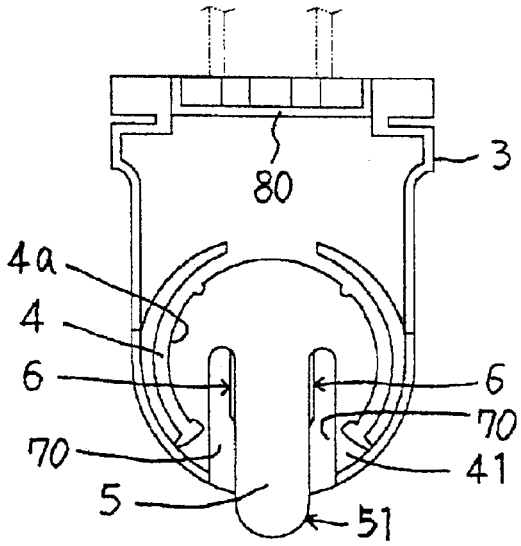
FIG. 2 is a front elevation view of a lamp-holder of the present invention.
Figure 3A:
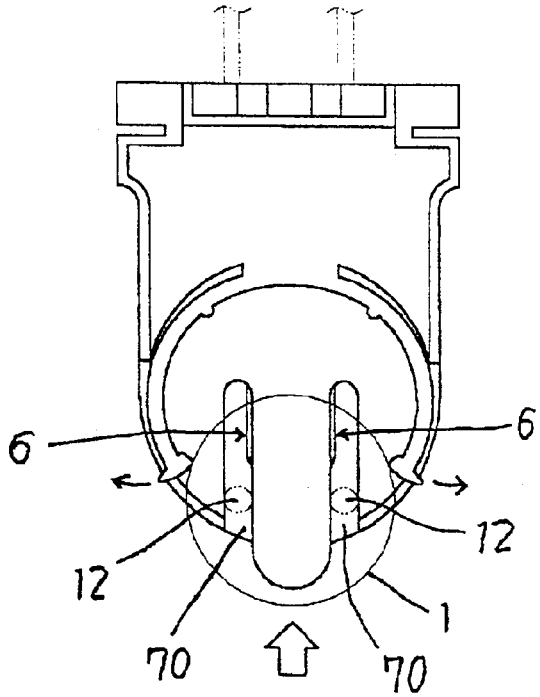
FIGS. 3*a* and 3*b* show the lamp-holder before and after a fluorescent lamp is inserted therein.
Figure 3B:
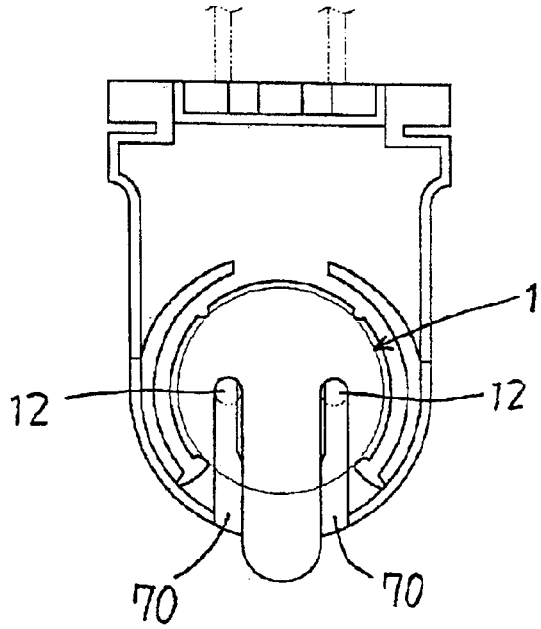
Figure 4:
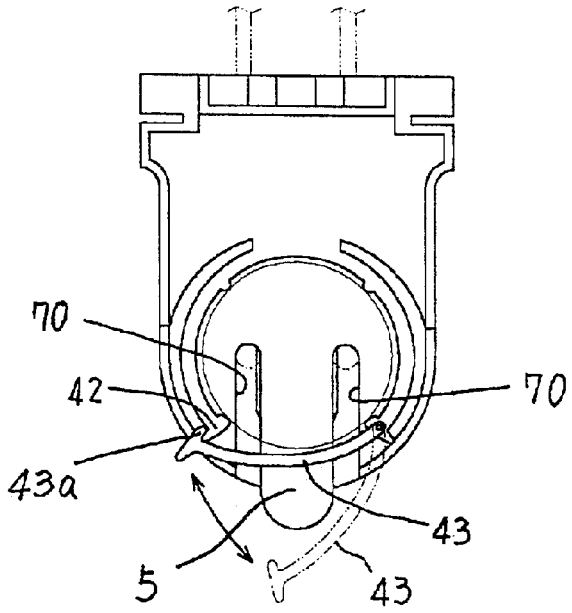
FIG. 4 is a view schematically showing locking operation of a snap latch of the socket.
Figure 5:
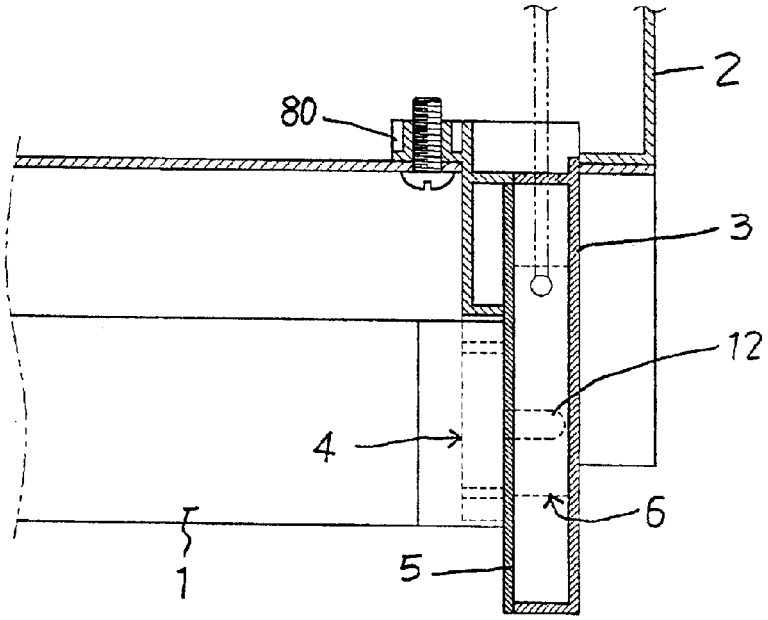
FIG. 5 is a cross-sectional view schematically showing a state that the fluorescent lamp is held in the lamp-holder.

FIGS. 1 to 5 show a lamp-holder for fluorescent lamp according to the present invention. As shown in drawings, the lamp-holder for fluorescent lamp "A" according to the present invention is adapted to hold metal caps 11 fixed to the opposite ends of a fluorescent lamp 1.

In the following description, though a common fluorescent lamp assembly normally has two lamp-holder at its opposite ends, only one lamp-holder displaced at its one end will be described for ease of explanation.

The lamp-holder "A" includes a lamp-holder body 3 fitted to a fluorescent lamp assembly 2 and extended downward, a resilient annular holder 4 provided at an inner side of the lamp-holder body 3 and having an access opening 41 facing downward, and a guide bar 5 provided in the annular holder 4 and at the inner side of the lamp-holder body 3 and extended downward, which has an arcuate guide surface 51 at its lower end. A screw fixing portion is forward protruded from the lamp-holder body 3, and is fixed to the fluorescent lamp assembly by a screw.

A pair of copper contact terminals 6 are resiliently attached to both sides of the guide bar 5 and electrically connected to a power source of the lamp assembly 2.

The annular holder 4 is formed at its both ends adjacent to the opening 41 with locking protrusions 42, respectively. A snap latch 43 is hingedly connected at its one end to one of the locking protrusions 42, and is adapted to be at its other end locked to the other locking protrusions 42, with a locking boss43*a* being locked in the locking protrusion 42 of the holder.

Copper contact terminals 6 are fixed to both sides of the guide bar 5, and are electrically contacted to a power source (not shown) of the lamp assembly 2. A grove 70 for receiving a contact pin 20 of the fluorescent lamp 1.

The annular holder 4 functions to grip an outer surface 11*a* of the metal cap 11 mounted on the opposite ends of the fluorescent lamp 1. The annular holder 4 is designed to resiliently hold the metal cap 11 of the fluorescent lamp 1 such that two arms of the annular holder 4 are resiliently displaced from each other while the fluorescent lamp 1 is passed through the opening 41, and to be returned to its original position after the fluorescent lamp 1 has been passed. The annular holder 4 is preferably made of synthetic resin. An inner grip surface 4*a* of the annular holder 4 is shaped to be round, so that the annular holder 4 can closely and snugly grip the metal cap 11 of the fluorescent lamp 1.

The guide bar 5 functions to guide insertion of the fluorescent lamp 1 such that contact pins 12 of the metal cap 11 of the lamp 1 come into contact with the guide surface 51 and then slide on the copper contact terminals 6 displaced at both sides of the guide bar 5, respectively, thereby causing the contact pins 12 to electrically contact with the contact terminals 6.

An operation of the lamp-holder for fluorescent lamp according to the present invention, which is constructed as explained above, will be described hereinafter.

When the service life of the fluorescent lamp 1 has expired, a user pulls out the fluorescent lamp 1 from the lamp holder "A" to replace it. At this time, since the metal cap 11 is applied with downward force and thus the metal cap 11 is pulled out of the holder 4 while expanding the arms of the holder 2 defining the opening 41, the holding condition of the metal cap 11 of the fluorescent lamp 1 is released. Therefore, the fluorescent lamp 1 can be easily pulled out of the lamp-holder by a simple pulling manipulation. After the fluorescent lamp 1 is pulled out of the holder 4, the lower ends of the holder 4 defining the opening 41 are restored to their normal positions by resilience thereof.

After the life-expired fluorescent lamp 1 is pulled out of the lamp-holder "A", a new fluorescent lamp 1 is pushed into the holder 4 through the opening 41. As the metal cap 11 fixed to the end of the fluorescent lamp 1 enters the holder 4 through the opening 41, the opening is expanded by resilience of the holder 4, thereby allowing the metal cap 11 to be passed therethrough. Subsequently, the arms of the holder 4 are retracted to their normal positions, so that the outer surface 11*a* of the metal cap 11 is tightly held by the inner grip surface 4*a* of the holder 4. In this way, as the metal cap 11 of the fluorescent lamp 1 is inserted into the lamp-holder "A", the contact pins 12 of the fluorescent lamp 1 come into contact with the copper contact terminal 6 attached to the guide bar 5 throughout lengths thereof, thereby enabling the fluorescent lamp 1 to be more reliably held in the lamp-holder "A". Therefore, the problems occurring in the conventional lamp-holder such as shortening of service life and safety hazard due to the poor electrical connection, can be effectively solved.

Furthermore, after the contact pins 12 of the metal cap 11 of the lamp 1 come into contact with the guide bar 5, the contact pins 12 slide along the arcuate guide surface 51 while rotating according to the contact position of the contact pins 12, thereby allowing the contact pins 12 to be correctly positioned. Subsequently, the contact pins 12 of the metal cap 11 come into contact with and slide along the copper contact terminals 6, respectively. Therefore, since the contact pins 12 of the fluorescent lamp 1 are automatically positioned to be connected to the copper contact terminals 6, the fluorescent lamp 1 can be easily and correctly held in the socker "A" regardless of inserting posture of the fluorescent lamp 1.

In addition, in cases where the lamp-holder for fluorescent lamp is used in such means of transportation as a train, a ship or the like, which usually generates vibration or shock, a fluorescent lamp con be more safely and reliably held in the lamp-holder of the present invention since the lamp-holder holds the fluorescent lamp in a such way that the snap latch 43 is locked at its free end to the mating locking protrusion 42 of the holder 4 in a snap manner to hold the metal cap 11 of the lamp 1.

As described above, the present invention provides a lamp-holder for fluorescent lamp including a lamp-holder body fitted to a fluorescent lamp assembly and extended downward, a resilient annular holder provided at an inner side of the lamp-holder body and having an access opening facing downward, and a guide bar provided in annular holder and at the inner side of the lamp-holder body and extended downward, which has an arcuate guide surface at its lower end. Therefore, the lamp-holder of the present invention is capable of receiving and withdrawing the fluorescent lamp by simple pushing and pulling manipulations so that the fluorescent lamp is easily replaced by anybody, and is also capable of more reliably and firmly holding the fluorescent lamp even under the condition of transport means such as a train, a ship or the like generating intensive vibration of shock. Furthermore, contact pins of a fluorescent lamp can be safely and reliably contacted with contact terminals throughout their lengths, thereby preventing short and thus lengthening its service life.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A lamp-holder for a fluorescent lamp adapted to be attached to each of the opposite sides of a fluorescent lamp assembly and having a lamp-holder body and a pair of contact terminals, the lamp-holder comprising:

a holder having a pair of resilient arms as part of the lamp-holder body, and holding the fluorescent lamp by pushing the lamp between the arms and a snap latch hingedly connected to one end of the lower end of at least one of the arms to prevent the fluorescent lamp from being attached, with a locking boss being locked in a locking protrusion of the holder.

2. The lamp-holder as claimed in claim 1, wherein the arms of the holder are extended downward in arcuate shape, and define an access opening for the fluorescent lamp between lower ends thereof, the arms being resiliently restored to normal positions thereof.

3. the lamp-holder as claimed in claim 1, further comprising a guide bar positioned between the pair of arms and extended downward, the guide bar having an arcuate guide surface for guiding insertion of the fluorescent lamp at its lower end.

* * * * *